United States Patent [19]

Nakanishi

[11] 4,106,800

[45] Aug. 15, 1978

[54] CHAIN LATCH FOR DOOR

[76] Inventor: Yoshitaka Nakanishi, 12-9 Yawata 5-chome, Ichikawa-shi, Chiba-ken, Japan

[21] Appl. No.: 758,186

[22] Filed: Jan. 10, 1977

Related U.S. Application Data

[63] Continuation of Ser. No. 618,956, Oct. 2, 1975, abandoned.

[30] Foreign Application Priority Data

Dec. 6, 1974 [JP] Japan ..... 49-140958
Jan. 30, 1975 [JP] Japan ..... 50-11862

[51] Int. Cl.[2] ..... E05C 17/36
[52] U.S. Cl. ..... 292/264; 292/238
[58] Field of Search ..... 70/93; 292/246, 264, 292/268, 304, 238

[56] References Cited

U.S. PATENT DOCUMENTS

| | | | |
|---|---|---|---|
| 878,294 | 2/1908 | Kleidmann | 292/264 |
| 963,427 | 7/1910 | Erkens | 292/268 |
| 1,722,736 | 7/1929 | Derbyshire | 292/268 |
| 2,036,679 | 4/1936 | Bourn | 292/264 |
| 2,805,093 | 9/1957 | Van Den Thoorn | 292/264 |
| 2,985,476 | 5/1961 | Tiffany | 292/264 |

FOREIGN PATENT DOCUMENTS

| | | | |
|---|---|---|---|
| 233,637 | 5/1925 | United Kingdom | 292/264 |

*Primary Examiner*—Richard E. Moore
*Attorney, Agent, or Firm*—Robert E. Burns; Emmanuel J. Lobato; Bruce L. Adams

[57] ABSTRACT

A chain latch for door comprising a chain which is set hanging between a door and a door-frame and limits the opening of the door for preventing wrongdoers from intrusion. One end of the chain is fixed to the door-frame, while to the other end of the chain is joined a locking member having an elongated slot. A retainer member carrying a hook which is hung with the locking member is fixed to the door, the hook having a neck portion engaging with the elongated slot of the locking member and a head portion formed into T-shape at the end of the neck portion for preventing the elongated slot of the locking member from getting out of the neck portion. When the door is in its closed position, a person on the inside can pass the elongated slot over the head portion for engaging the locking member with the neck portion of the hook or putting the former out of the latter. When the door is in an opened position even slightly, the elongated slot and the head portion of the hook cross each other so that nobody can remove the locking member away from the neck portion of the hook.

2 Claims, 11 Drawing Figures

CHAIN LATCH FOR DOOR

This is a continuation of application Ser. No. 618,956, filed Oct. 2, 1975, now abandoned.

BACKGROUND OF THE INVENTION

This invention relates to a chain latch for doors and more particularly to a latch of such a type as to put restriction upon the opening of a door with the help of a chain suspended between the door and the door-frame for preventing the entry of intruders.

In the case of chain latch of this sort, hitherto, it has been possible that in spite of keeping a door locked with a chain, the chain can be disconnected from the outside so that the safety of insider against intruder can not be guaranteed.

An object of this invention is to provide a chain latch which cannot be removed from a door when opened even slightly and can be disconnected only when the door is closed.

Another object of the invention is to provide a chain latch of simple and economical structure with such a firmness as sufficiently resistible against fairly rough handling.

SUMMARY OF THE INVENTION

In the preferred embodiment of the present invention, a chain having a locking member at its free end is set hanging onto a door-frame or door, the locking member being provided with an elongated slot; and a hook engaging with the elongated slot of the locking member is fixed on the door or door-frame, the hook having a long and slender head portion of nearly the same shape as the elongated slot of the locking member and a neck portion that supports the head portion. Only when the door is closed, can the elongated slot of the locking member pass over the head portion to engage with the neck portion or to be released from such engagement. When the door is opened on the other hand, even to a slight degree, the locking member is held by the chain because the elongated slot and the head portion to cross each other so as to make it impossible for the locking member to be disengaged from the hook; this and other objects and advantages of the present invention will become clear from the detailed description given below with reference to the appended drawings;

BRIEF DESCRIPTION OF THE DRAWINGS

In FIGS. 1-6, a door 1 is shown which can be completely closed with the door-frame 2 standing abreast therewith in the same plane as best shown in FIG. 3. On the inner front face of the door-frame and near one side thereof is fixed by screws 5 a base plate 4 of a hanger 3, the base plate 4 being provided with a bracket 7 projecting forwardly therefrom and having a horizontal hole 6.

Figure 2:
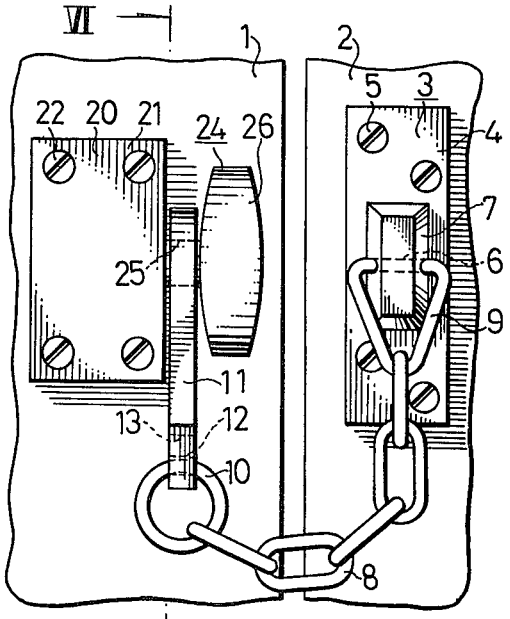
FIG. 2 is a front elevational view showing the state in which a door is completely closed and latched with the chain latch.
Figure 1:
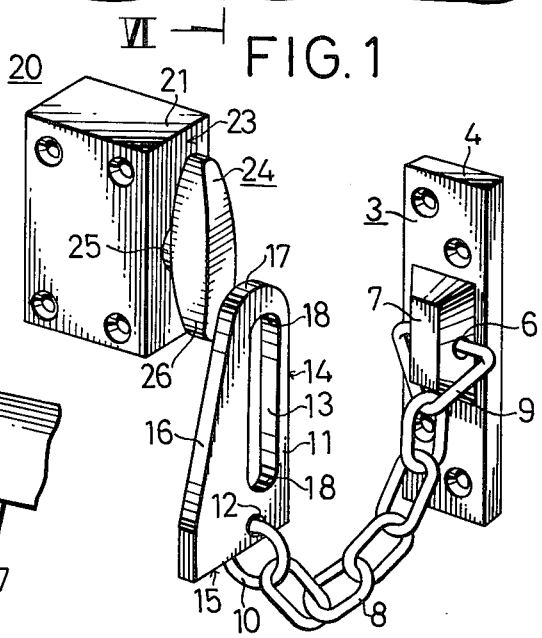
FIG. 1 is a perspective view of a chain latch for doors according to the preferred embodiment of the present invention.
Figure 6:
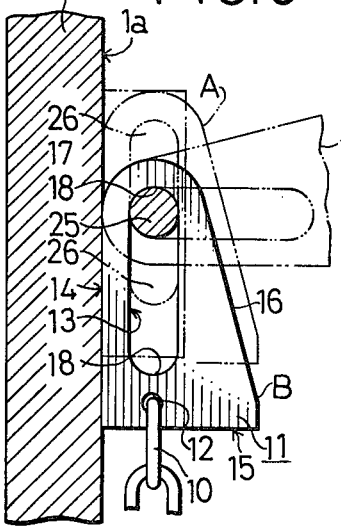
FIG. 6 shows the cross section along the line VI—VI of FIG. 2.
Figure 8:
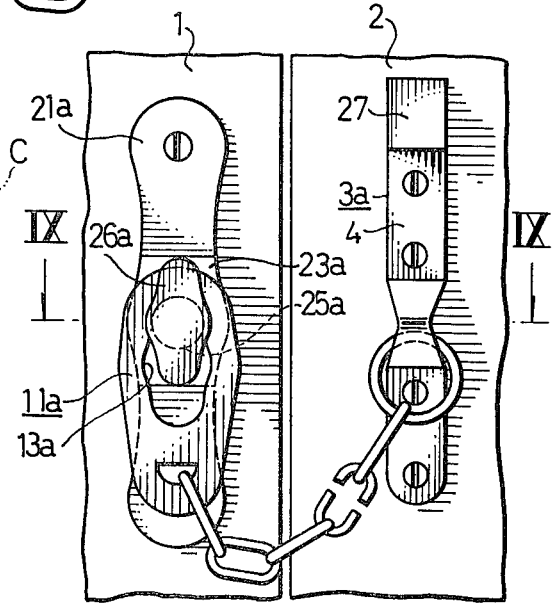
FIG. 8 illustrates the application to the door of the modified chain latch shown in FIG. 7 and is a front elevational view similar to FIG. 2.
Figure 7:
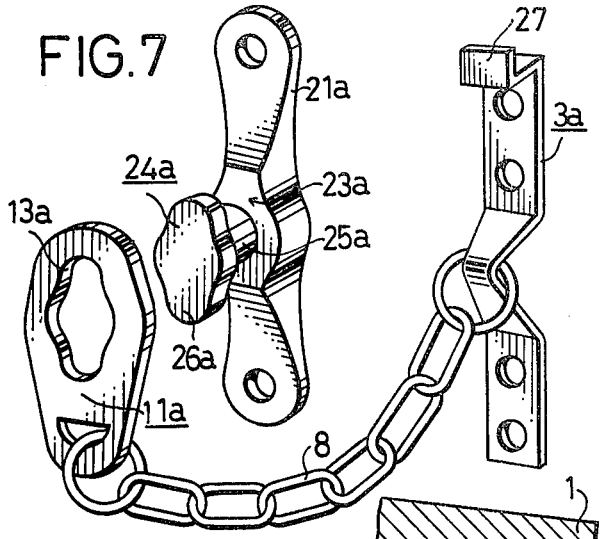
FIG. 7 shows a modification of the chain latch according to the present invention and is a perspective view similar to FIG. 1.
Figure 11:
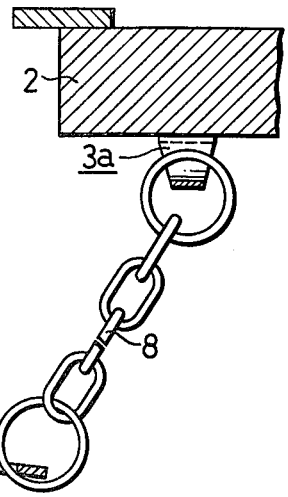
FIG. 11 shows the cross section along the line XI—XI of FIG. 10.

A chain 8 is connected to the hanger 3 by rotatably inserting a terminal link 9 on a first end of the chain in the hole 6 of the bracket. To the second or free end of the chain 8 a locking member or plate 11 having an elongated narrow and straight slot 13 is connected by passing a terminal link 10 of the chain through a hole 12 in an end of the locking member. The locking member or plate 11 is as shown made approximately in the general form of a right-angled triangle having a longer side 14 close and parallel to the elongated slot 13 and having a shorter side 15 to which the free end of the chain 8 is connected. A corner part 17 where the longer side 14 and a hypotenuse 16 intersect each other, is formed and modified by rounding it in a configuration of arc of a circle concentrical with a semicircular part 18 on end of the elongated slot 13. One of the other corner parts, the one remote from the long side 14, may be cut off or blunted, as shown. However, this part and the remainder of the portion of plate 11 adjacent the chain-connecting hole 12 are wider than the rounded corner portion 17, and thereby constitute weight means on the locking plate member 11 so dimensioned and disposed that this locking member, when slidably held in slot 13, tends to gravitationally slide down, along this slot, with the wider part of the plate in lower position, as also shown. The sliding down evidently continues until the upper end of the slot, opposite this weight means, engages the neck 25, which then acts as a stop. Pursuant to such sliding and engaging, the locking member or plate is turned by chain 18, raising the wider part of the plate, when the door is opened (as best shown in FIGS. 1, 2 and 6).

Figure 3:
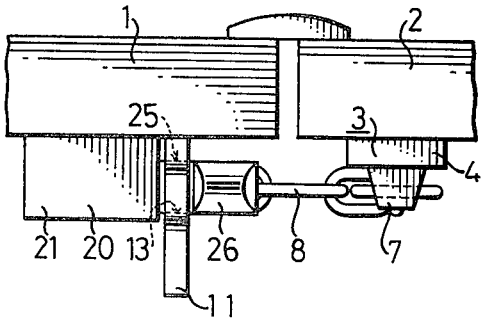
FIG. 3 is a plan view of the state shown in FIG. 2.

Onto the inner front face of the door 1, adjacent the door frame is fixed a base plate 21 of a retainer member 20 by screws 22. The base plate is provided with a retainer shown as a double hook 24, having a neck 30 provided by a shaft 25 extending laterally from a side surface 23 of the base plate towards the door-frame 2. The retainer or double hook has an elongated head portion 26 extending upward and downward from the free end of the neck or shaft to meet therewith at a right angle. The diameter of the neck 25 is smaller than the width of the elongated slot 13 of the locking member 11 so that the slot 13 of the locking member connected with the double hook, can easily rotate about or slide along this neck as shown in FIG. 6. The length of the neck 25 is a little greater than the thickness of the locking member 11 ash shown in FIG. 5, so that the locking member can smoothly rotate and slide along the mutually opposing faces of the base plate 21 of the retainer member and the head portion 26 without rattling against the faces. As additionally shown in FIG. 6, peripheral side of the neck 25 closest to the door front face 1*a* is spaced from this face 1*a* by a distance a little wider than the dimension between the longer side face 14 of the locking member 11 and wall of the slot 13 adjacent to the side face 14, so that the longer side face 14 of the locking member can slide on the door front face 1*a* when the elongated slot 13 of the locking member moves upwardly and downwardly on the neck 25. Therefore, except in the lowermost position of the locking member, shown in full lines the locking member 11 can only move upwardly and downwardly, neither rotating about the neck nor changing the direction of the elongated slot 13. Both length and width of the side of the head portion 26 are a little smaller than the corresponding dimensions of the elongated slot 13 of the locking member, so that the elongated slot 13 allows the head portion to pass therethrough. When the elongated slot 13 of the locking member 11 is applied exactly to the head portion 26 and moved along the neck 25, the elongated slot 13 enters into the engagement with the neck 25 and the locking member 11 goes down from an upper position A shown by chain line to a lower position B shown by solid line in FIG. 6 until the upper end 18 of the elongated slot 13 collides and engages with the neck 25. By conducting the operation in reversed order with the locking member lifted from the settled position, the locking member will be detached from the neck 25. This applying and detaching of the locking member can be done, conveniently from inside the closed door, FIG. 3, by manipulating the wide end of the locking plate.

In order to make it impossible for an intruder to detach the locking member 11 from the hook 24, the chain 8 has such a length that the elongated slot 13 of locking member can be adapted to the head portion 25 of the hook only when the door is substantially fully closed.

Figure 4:
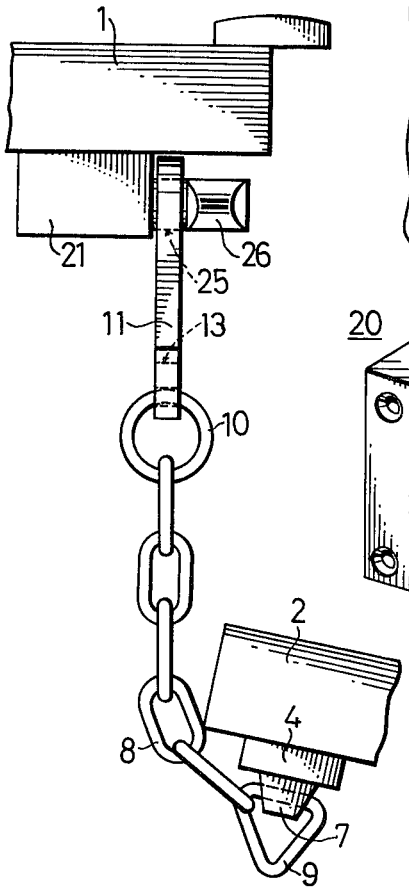
FIG. 4 is a plan view showing the state in which the door is opened to the maximum defined by the length of the chain of the chain latch.
Figure 5:
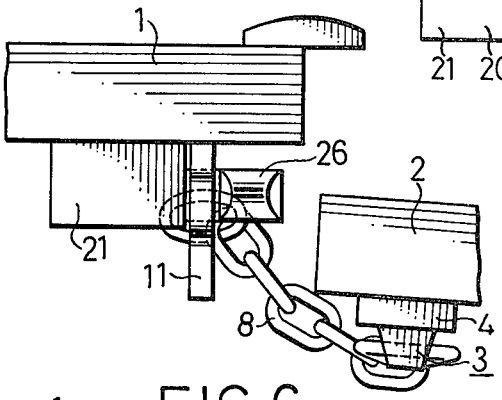
FIG. 5 is a plan view showing the chain latch in a position between those of FIGS. 3 and 4.

When the door is in an almost fully closed position FIG. 5, the locking member hung on the neck 25 of hook, may still be aligned with the head portion 26 of the hook, but is hardly accessible, as the side edge of the door frame 2 is interposed. As the door is turned towards its fully opened position, FIG. 4, the locking member 11 is revolved being, pulled by the chain 8, about the neck 25 so that the elongated slot 13 crosses the head portion 26 and arrives at the position C shown in broken line in FIG. 6, when the door is fully opened FIGS. 5 and 3. When the door is turned towards its closed position, on the other hand, the locking member returns to the original lower position B by the weight of the locking member and the chain. Such being the case, the elongated slot 13 of the locking member 11 is still not detachable from the hook so that it is impossible to unfasten the locking member, particularly from the outside. Thus, even when attempt is made in such position to unfasten the locking member for example by means of a flexible instrument, such as wire, inserted through an opening between the free end of the door 1 and the door-frame, it is very difficult for a person on the outside to unfasten the locking member 11. This is true particularly because the lifting of the elongated slot 13 of the locking member 11 along the neck, and the aligning of the elongated slot 13 to the head portion 26 must be done under a very unstable condition namely, when the neck is between the two ends of the elongated slot, and not at either end of the slot. Further, even if an intruder were able to operate so that the elongated slot 13 is successfully aligned to the head portion 26, it would still be difficult for him from the outside to move the locking member 11 laterally in parallel to the inner door front face for unfastening the locking member from the hook 24.

As the engagement of the locking member 11 with the hook 24 is maintained through the rotation of the former, it is possible, further, to make the chain relatively shorter taking into account the radius of rotation. As there is no slot or the like on the base plate 21 of the retainer member 20, the base plate may be make quite to compact as a whole and smart in appearance, and there is no possibility that the chain latch becomes unusable as a result of a slot opening of the base plate of the retainer member or other filling with dust, as happened with earlier constructions.

In FIGS. 7–11, the neck portion 25*a* of a hook 24*a* extends integrally from the front face 23*a* of a base plate 21*a* fixed on the inner front face of a door 1 in the direction perpendicular to the door 1 and to the end of this neck portion 25*a* is joined, meeting at a right angle therewith, a head portion 26*a* elongated upward and downward. The relative dimensional correlations between the diameter of the neck portion 25*a* and the width of the elongated slot 13*a* of the locking member 11*a*, between the length of the neck portion 25*a* and the thickness of the locking member 11*a*, between the length and width of the front face of the head portion 26*a* and between the length and width of the elongated slot 13*a* of the locking member 11*a* are each the same as in the former example. By aligning the elongated slot 13*a* of the locking member 11*a* to the head portion 26*a* and moving the locking member 11*a* horizontally along the neck portion 25*a*, the elongated slot 13*a* is brought into the engagement with the neck portion 25*a* thereupon the locking member 11*a* goes down until the upper end of its elongated slot 13*a* abuts against the neck portion and is hung on the neck portion 25*a* to assume an attitude parallel to the inner front face of door (FIG. 8) where it is practically unaccessible, from the outside, for detaching manipulation. By making the locking member 11*a* transfer along the reverse course from the position to which it has descended, the locking member is detached from the neck portion 25*a*. The detached locking member 11*a* may be hung by engaging its slot 13*a* with a hook 27 of a hanger 3*a* fixed on door-frame 2.

Figure 10:
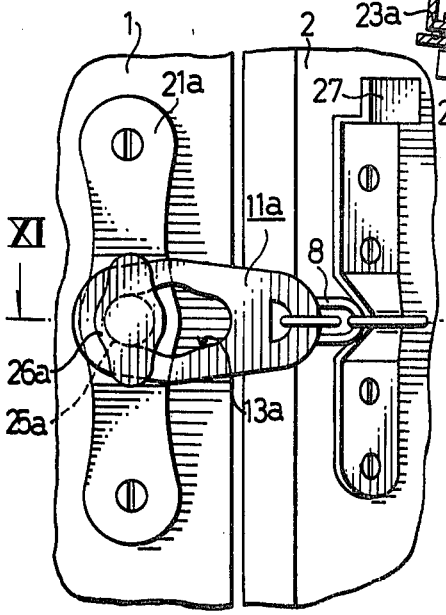
FIG. 10 is a front elevational view showing the state in which a door is opened to the maximum defined by chain length of the chain latch shown in FIG. 7.
Figure 10:
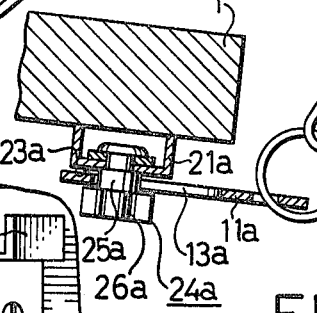
Figure 9:
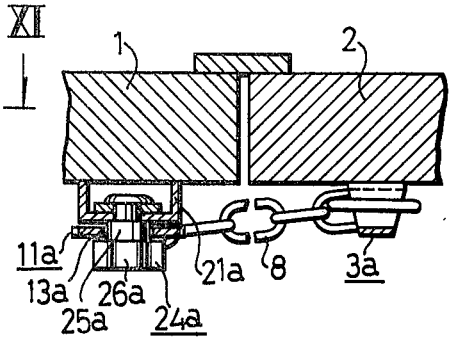
FIG. 9 shows the cross section along the line IX—IX of FIG. 8.

The looking member 11*a*, which is hung on the neck portion 25*a* of the hook in such a state that the slot 13*a* of the locking member may be aligned with the head portion 26*a* when the door is at a fully closed position, can be rotated about the neck portion 25*a* in a plane parallel to the front face of the door to cross with the head portion 26*a* by lateral pulling force of the chain in accordance with the rotation of the door to the fully opened position; and when the door is at fully opened position, the locking member 11*a* takes a sidelong position as shown in FIG. 10. When the door is turned towards its closed position, the locking member returns to the original position owing to its own weight and tare of the chain.

Despite some examples of embodiment as described above, it is clear that the present invention is not to be limited to these examples, but can be variously modified within the scope of the spirit of invention set forth in the patent claims.

What is claimed is:

1. A door latch, comprising;

a chain;

a base for fixing a first end of the chain to an inside surface of one of a door unit and a door-frame unit;

a locking plate shaped to approximately resemble a triangle modified by rounding a corner thereof, the locking plate having an elongate slot extending from adjacent the rounded corner along one side of the triangle, and having a wide locking plate portion disposed adjacent an end of the slot remote from the rounded corner, said portion being fixed to a second end of the chain;

a retainer plate attachable to an inside surface of another of said units; and a hook secured to the retainer plate for engagement with and disengagement from the locking member from inside the door and door-frame units when the door is closed and for preventing such disengagement from outside said units, the hook being T-shaped, having a horizontal shaft extending into and secured to the retainer plate, and extending from the retainer plate in a direction parallel to the surface of the unit to which the retainer plate is secured, and perpendicular to the head of the hook, the shaft having a vertical head which extends upwardly and downwardly from a free end of the shaft, said head being dimensioned to permit sliding of the locking plate onto and from the hook, for respectively effecting said engagement and disengagement, but to permit such sliding only when the slot is vertical and the shaft is centered therewith, whereby the wide locking plate portion tends to cause the locking plate, upon its engagement with the hook, to gravitationally slide down on the shaft of the hook with the wide locking plate portion disposed downwardly until the shaft engages an end of the slot adjacent the rounded corner, while permitting that, pursuant to such sliding and engaging, the locking plate is turned on the shaft by the chain, when the door is opened, to prevent said disengagement.

2. A latch according to claim 1 in which the ends of the slot are rounded, the rounding of one end being concentric with the rounded corner.

* * * * *